United States Patent [19]

Staerzl

[11] 4,391,255

[45] Jul. 5, 1983

[54] PROGRAMMED SEQUENTIAL FUEL INJECTION IN AN INTERNAL COMBUSTION ENGINE

[75] Inventor: Richard E. Staerzl, Fond du Lac, Wis.

[73] Assignee: Brunswick Corporation, Skokie, Ill.

[21] Appl. No.: 232,374

[22] Filed: Feb. 6, 1981

[51] Int. Cl.[3] ..... F02D 17/00

[52] U.S. Cl. ..... 123/481; 123/198 F

[58] Field of Search ..... 123/481, 198 F

[56] References Cited

U.S. PATENT DOCUMENTS

| | | | |
|---|---|---|---|
| 2,771,867 | 11/1956 | Peras | 123/481 X |
| 2,875,742 | 3/1959 | Dolza | 123/481 |
| 4,040,395 | 8/1977 | Demetrescu | 123/486 X |
| 4,098,252 | 7/1978 | Abthoff et al. | 123/198 F |
| 4,129,109 | 12/1978 | Matsumoto | 123/481 X |
| 4,274,382 | 6/1981 | Sugasawa et al. | 123/481 |

*Primary Examiner*—Tony M. Argenbright

*Attorney, Agent, or Firm*—Hopgood, Calimafde, Kalil, Blaustein & Judlowe

[57] ABSTRACT

An electronic control circuit for a fuel injected internal combustion engine in which fuel flow is alternated among selected engine cylinders at low speed engine operation. Alternate fuel delivery results in improved idle, fuel economy and reduced emissions. Conventional engine operation is progressively restored as the engine approaches high speed operation.

6 Claims, 2 Drawing Figures

| THROTTLE OPENING | COMPARATOR 11 | 12 | 13 |
|---|---|---|---|
| 0° TO 20° | 1 | 1 | 1 |
| 20° TO 35° | 0 | 1 | 1 |
| 35° TO 50° | 0 | 0 | 1 |
| 50° TO 75° | 0 | 0 | 0 |

PROGRAMMED SEQUENTIAL FUEL INJECTION IN AN INTERNAL COMBUSTION ENGINE

BACKGROUND OF THE INVENTION

This invention relates to an electronic fuel-injection control circuit for an internal combustion engine and more particularly to a programmable control circuit designed to improve fuel economy, engine idle and reduce emissions. Reference is made to commonly assigned, co-pending patent application Ser. No. 120,467 filed Feb. 11, 1980, now U.S. Pat. No. 4,305,351, for greater descriptive detail of a fuel injected engine, to which the present invention is illustratively applicable.

In fuel-injection control circuits of the character indicated, and in particular, for such control circuits when used with two-cycle V-6 engines of the type described in co-pending patent application Ser. No. 120,467, all engine cylinders are injected with fuel during each revolution of the engine crankshaft. Fuel injection for all engine cylinders during each crankshaft revolution is necessary at or near a maximum engine throttle opening to provide sufficient fuel for high speed engine operation. However, it has been found that at low speed operation, i.e., at less than maximum engine throttle opening, fuel may be advantageously injected to less than all engine cylinders during each crankshaft revolution with resultant improvement in fuel economy, engine idle and engine emissions.

BRIEF STATEMENT OF THE INVENTION

It is a general object of the present invention to provide an electronic fuel injection control circuit for an internal combustion engine that improves fuel economy, engine idle and reduces engine emissions at low speed engine operation.

It is a feature of the present invention that the general object outlined above is achieved by permitting fuel flow to selected cylinders during each crankshaft revolution while preventing fuel flow to other cylinders.

It is another feature of the instant invention that fuel flow to the engine cylinders is progressively restored to conventional operation as the engine approaches high speed operation.

It is a further feature of the instant invention that in a multibank internal combustion engine fuel flow is alternated from one engine bank to the other during successive crankshaft revolutions.

The foregoing and other objects and features of this invention will be more fully understood from the following description of an illustrative embodiment thereof taken in conjunction with the accompanying drawings.

DETAILED DESCRIPTION

Figures 1, 2:
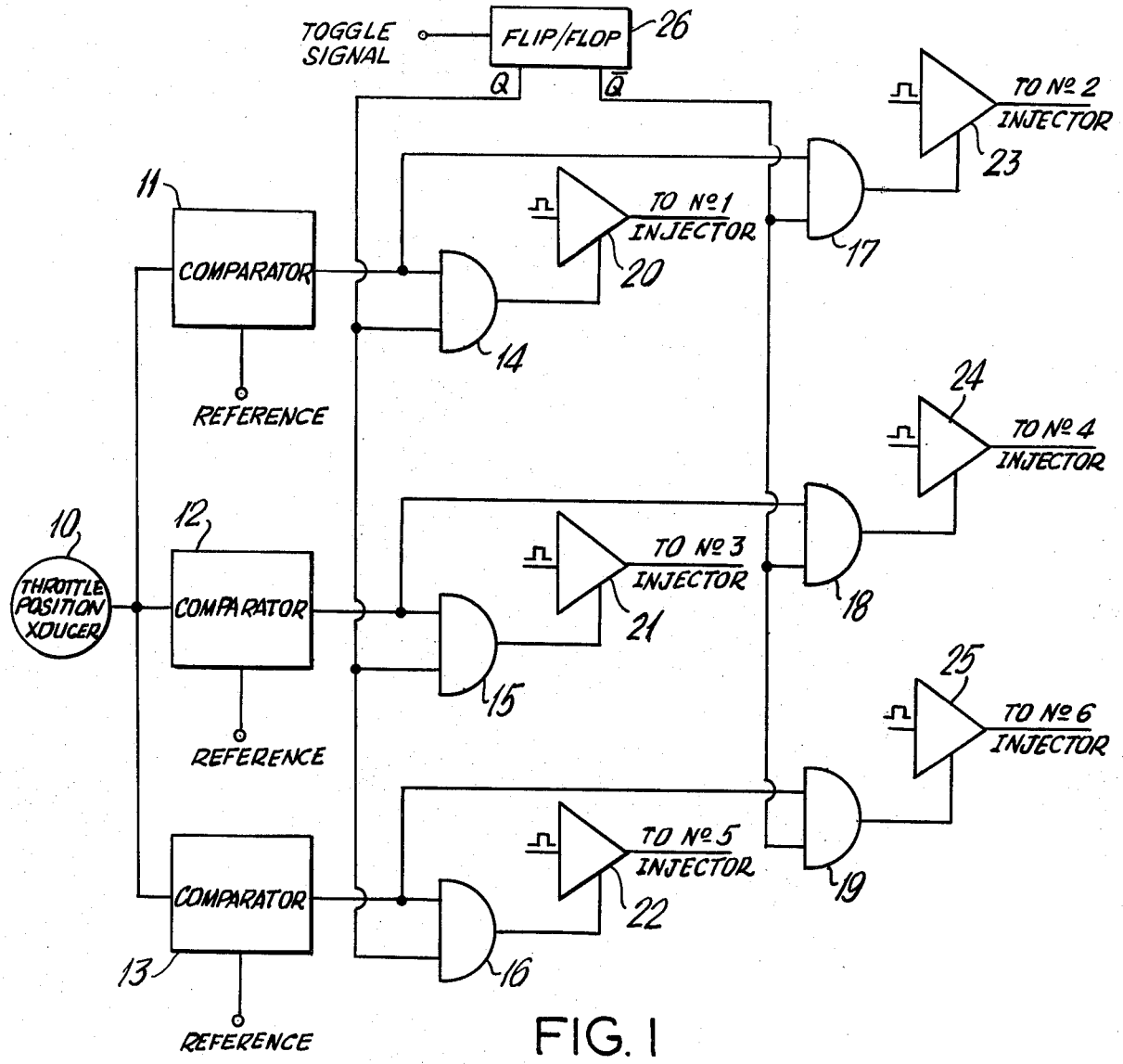
FIG. 1 illustrates, in block diagram form, the programmable fuel-injection control circuit of the instant invention.
FIG. 2 shows a truth table for comparators A, B and C illustrated in FIG. 1.

The instant invention may advantageously be used with any two cycle internal combustion engine adapted for fuel injection. The particular embodiment shown in FIG. 1 is designed for use with a fuel injected two-cycle six cylinder 60 degree V-engine of the type described in co-pending patent application Ser. No. 120,467. In said co-pending patent application one or more square wave pulse generators drive solenoid-operated fuel injectors unique to each engine cylinder. The engine control system modulates the pulsegenerator means as necessary to accommodate throttle demands in the context of engine speed and other factors. Engine cylinders #2, #4 and #6 are simultaneously injected with fuel under the control of the pulse output of a first square wave generator while the remaining fuel injectors for cylinders #1, #3 and #5 are operated simultaneously under the control of the pulse output of a second generator. All cylinders are injected with fuel during each revolution of the engine crankshaft.

Referring now to FIG. 1, the function of the illustrated control circuit is to alternate fuel flow to every cylinder at small throttle openings (low speed engine operation). The cylinders are progressively restored to conventional operation as the throttle opening is increased so that at or near maximum throttle opening all the cylinders are converted to conventional operation with conventional operation as used herein being the type of operation described in co-pending patent application Ser. No. 120,467.

In a multibank engine alternating fuel flow to the engine cylinders is accomplished by alternating fuel flow from one engine bank to the other. For example, in a V-6 two cycle engine at closed throttle during one revolution, the even cylinders would receive fuel and the odd cylinders would not receive fuel. This procedure would be reversed during the following revolution. Such an alternate fuel delivery action allows for cylinder lubrication during the first revolution, when the cylinder is receiving fuel, and a good exhaust gas purge during the second revolution. Achieving a good gas purge when a cylinder is not receiving fuel provides a smoother idle and improved fuel economy due to improved combustion. This same action pumps air into the exahust cavity which reduces exahust emissions at small throttle openings. Alternate fuel feed also helps maintain even cylinder temperature.

To provide alternate fuel feed at small throttle openings and conventional fuel feed at or near maximum throttle openings, it is necessary to provide a throttle position dependent control signal. Such a control signal is provided by throttle position transducer 10. Transducer 10, shown in block diagram form in FIG. 1, is described in detail in commonly assigned, co-pending patent application Ser. No. 169,365, filed July 16, 1980, now U.S. Pat. No. 4,280,465. More particularly, as shown in FIG. 5 of patent application Ser. No. 169,365, the transducer provides an output signal whose magnitude is dependent on the throttle position angle with a small throttle opening (small angle) producing a low level signal and a wide throttle opening (large angle) providing a high level signal. The range of throttle adjustment is illustratively given at 75 degrees in patent application Ser. No. 169,365 and this is the range of throttle adjustment for throttle position transducer 10.

The throttle position dependent control signal from transducer 10 is applied to comparators 11–13, which compare the voltage level of the throttle position dependent control signal with a fixed reference voltage. Each comparator, in response to the varying level of the throttle position dependent control signal, produces logical "1" or logical "0" output signals in a predetermined pattern. More particularly, as shown in FIG. 2, each of comparators 11–13 produce a logical "1" output signal for throttle openings of 0° to 20°. For throttle openings of 20° to 35° comparator 11 produces a logical "0" output signal while comparators 12 and 13 produce logical "1" output signals. Throttle openings of 35° to 50° result in logical "0" output signals from comparators 11 and 12, and a logical "1" output signal form comparator 13. Similarly throttle openings of 50° to 75° result in logical "0" output signals from each of comparators 11–13. It is of course understood that comparators 11–13 could be programmed to produce other output signal patterns as required for varying engine operation in the manner described hereinafter.

The output signals from comparators 11–13 are applied to AND gates 14–19 in the manner shown in FIG. 1, and logically combined with the output from commutating flip-flop 26. The commutating flip-flop receives one toggle pulse per crankshaft revolution in a two cycle engine. Means for applying a toggle signal to flip-flop 26 are not shown as the generation of such a signal from crankshaft movement would be apparent to one skilled in this technical area.

Assume for illustrative purposes that flip-flop 26 is in the SET state such that the Q output is at a logical "1" level and the $\overline{Q}$ output is at a logical "0" level. In this state AND gates 14–16 are enabled and AND gates 17–19 are disabled. Disabling AND gates 17–19 applies a logical "0" signal to injector driver stages 23–25. All injector driver stages are enabled by the application of a logical "0" signal. Accordingly the square wave pulses schematically shown at the inputs to driver stages 23–25 are applied to the fuel injectors (not shown) for cylinders #2, #4 and #6, thereby supplying fuel to these cylinders in accordance with the teachings in co-pending patent application Ser. No. 120,467.

Enabling AND gates 14–16 applies the outputs of comparators 11–13 to injector driver stages 20–22. At a throttle opening of 0° to 20°, the comparator outputs are all equal to a logical "1" level. A logical "1" signal disables the injector drivers and accordingly no fuel is applied to cylinders #1, #3 and #5 when flip-flop 26 is SET and the throttle opening is between 0° to 20°.

As the throttle opening is increased the operation of the fuel injectors is progressively restored to conventional operation. More particularly at a throttle opening of 20° to 35° injector drivers 21 and 22 are disabled while injector driver 20 is enabled. At a throttle opening of 35° to 50° injector driver 22 is disabled while injector drivers 20 and 21 are enabled. Finally, at a throttle opening of 50° to 75°, all injector drivers are enabled, restoring the engine to conventional operation.

It is, of course, understood that upon each revolution of the crankshaft flip-flop 26 will receive a toggle signal and change state in response thereto. When flip-flop 26 is in the clear state the $\overline{Q}$ output is at a logical "0" level, disabling AND gates 14–16 and enabling injector drivers 20–22. Similarly the Q output is at a logical "1" level, enabling AND gates 17–19 and applying the output signals from comparators 11–13 to injector drivers 23–25. Injector drivers 23–25 are controlled by the comparator outputs in the manner previously described in conjunction with the operation of injector drivers 20–22. In this manner fuel flow is alternated from one bank to the other at small throttle openings and progressively restored to conventional operation as the throttle opening increases.

While the invention has been described in detail for preferred and illustrative embodiments, it will be understood that modification may be made without departure from the claimed scope of the invention.

I claim:

1. A fuel-injection control circuit for an internal-combustion engine, said internal-combustion engine having a variable position throttle and a plurality of engine cylinders with each cylinder having associated therewith individually controllable fuel injection apparatus, the fuel injection control circuit comprising, means for generating a throttle position control signal whose voltage level is dependent upon the movement of said variable position throttle from a closed position to an open position and from an open position to a closed position, means for comparing the voltage level of said throttle position control signal with a fixed reference level and for generating a predetermined pattern of logic signals in response to said comparison, a bistable device which changes state once per crankshaft revolution of said internal combustion engine and means responsive to said predetermined pattern of logic signals and to the state of said bistable device for applying enabling signals to a minimum number of said individually controllable fuel injection apparatus at an essentially closed throttle position, for progressively applying said enabling signals to a greater number of said individually controllable fuel injection apparatus as said variable position throttle moves from an essentially closed position to nearer said open position and for applying said enabling signals to all of said individually controllable fuel injection apparatus when said variable position throttle reaches said open position.

2. A fuel injection control circuit in accordance with claim 1, wherein said comparing and generating means includes a plurality of individual comparing devices, the output of each individual comparing device being a binary logic signal whose logic state changes in response to changes in the voltage level of said throttle position control signal.

3. A fuel injection control circuit in accordance with claim 2, wherein said selectively applying means includes a plurality of two input AND gates, a first subset of said AND gate plurality being associated with a first selected group of said engine cylinder plurality and a second subset of said AND gate plurality being associated with a second selected group of said engine cylinder plurality.

4. A fuel injection control circuit in accordance with claim 3, wherein said bistable device includes two complementary output signals, a first one of said complementary output signals being applied to one input of said first subset of AND gates, the other of said complementary output signals being applied to one input of said second subset of AND gates, and the output of each individual comparing device being applied to selected ones of the remaining inputs of said first and second subset of AND gates.

5. A fuel injection control circuit in accordance with claim 4, wherein there is further included means for controlling each of said individually controllable fuel injection apparatus, said controlling means being enabled by an output signal from said first and second subset of AND gates.

6. A fuel-injection control circuit for a dual bank internal-combustion engine, said internal-combustion engine having a variable position throttle and a plurality of engine cylinders divided equally between each of said engine banks, each engine cylinder having associated therewith individually controllable fuel injection apparatus, the fuel injection control circuit comprising, means for generating a throttle position control signal whose voltage level is dependent upon movement of said variable position throttle from a closed position to an open position and from an open position to a closed position, means for comparing the voltage level of said throttle position control signal with a fixed reference level and for generating a predetermined pattern of logic signals in response to said comparison, a bistable device which changes state once per engine revolution of said internal combustion engine, and means responsive to the state of said bistable device and said predetermined pattern of logic signals for alternatively applying enabling signals to the fuel injection apparatus associated with each engine bank at an essentially closed throttle position, for progressively applying said enabling signals to a greater number of said individually controllable fuel injection apparatus as said variable position throttle moves from an essentially closed position to nearer said open position and for applying said enabling signals to all of said individually controllable fuel injection apparatus when said variable position throttle reaches said open position.

* * * * *